United States Patent [19]

Marforio

[11] 4,067,274

[45] Jan. 10, 1978

[54] FEED ADJUSTING DEVICE FOR SEWING MACHINES

[75] Inventor: Nerino Marforio, Milan, Italy

[73] Assignee: Rockwell-Rimoldi S.p.A., Milan, Italy

[21] Appl. No.: 736,892

[22] Filed: Oct. 29, 1976

[30] Foreign Application Priority Data

Nov. 7, 1975 Italy ..... 29054/75

[51] Int. Cl.[2] ..... D05B 27/02

[52] U.S. Cl. ..... 112/209

[58] Field of Search ..... 112/209, 208, 210, 215

[56] References Cited

U.S. PATENT DOCUMENTS

| | | | |
|---|---|---|---|
| 2,009,747 | 7/1935 | Sauer | 112/209 |
| 2,782,742 | 2/1957 | Hess | 112/209 |
| 2,974,617 | 3/1961 | Hacklander | 112/209 |
| 3,450,079 | 6/1969 | Lukin | 112/209 |
| 3,611,817 | 10/1971 | Smith et al. | 112/209 |

*Primary Examiner*—George H. Krizmanich

[57] ABSTRACT

An improved feed adjusting apparatus for sewing machines having a control device which reduces to a minimum the displacement between the actual path and the optimum path of travel of a slider during its intended function of transforming the oscillating movement of the feed advance shaft to reciprocating movement of the bar that supports the machine's feed dogs.

3 Claims, 3 Drawing Figures

FEED ADJUSTING DEVICE FOR SEWING MACHINES

BACKGROUND OF THE INVENTION

The present invention relates to a feed adjusting means for a sewing machine comprising a feed advance shaft on which is keyed an arm equipped with a guide bar. A slider which is in driving connection with a feed dog bar of the feed system is mounted on the guide bar.

Feed adjusting devices of the aforementioned type are already known in the art; these devices comprising a forked slider which is engaged with the slider and control means which are connected to the forked slider to move the slider along the guide bar and, when the latter is in motion, to vary the stroke of the feed dog bar and thus to vary the quantity of fabric advanced for each stitch formed by the sewing machine.

In the known devices, the forked slider is supported by a system of levers disposed so as to form substantially a parallelogram with the forked slider. However, this system tends to modify the form and position of the path of the slider as, during feed adjustment, the forked slider is displaced substantially parallel to itself along the guide bar which oscillates and thus the axis of the forked slider, along which the slider is displaced, moves even further from the optimum arc of the circle along which this slider would move if it were not retained by the forked slider and thus unless the slider is disposed remote from the axis of the feed advance shaft. During operation of the sewing machine, the displacement between the actual rectilinear path of the slider and the ideal path along the arc produces a continuous reciprocating movement of the slider along the guide bar; the amplitude of this reciprocating movement increasing in proportion to the aforementioned displacement.

The reciprocating movement produces excessive wear between the slider and the guide bar, vibrations which affect all the elements of the sewing machine and, in particular, those of the feed device, and also a substantial variation in the law of movement of the feed dog bar.

The object of the present invention is to reduce to a minimum the displacement between the actual path and the optimum path of the slider so as to eliminate any vibrations and avoid excessive wear to the elements of the feed device.

The technical problem to be solved in achieving this end is that of keeping the axis of the forked slider, and thus the actual path of the slider, coincident with the chord of this optimum path in every position of the slider with respect to the advance shaft.

SUMMARY OF THE INVENTION

The solution to this technical problem is provided by a feed adjusting device of the aforementioned type which comprises support means for the forked slider capable of keeping the axis of the latter disposed coincident with, or substantially coincident with, the chord of the arc corresponding to the positioning of the slider along the guide bar with respect to the axis of the feed advance shaft.

Another feature consists in that the support means includes a rod-type element pivotably mounted on a pin whose axis is parallel to the feed advance shaft, and the forked slider is slidably mounted on this rod-type element in such a way that the prongs with which this slider is provided forms an angle of 90° with respect to said rod-type element.

Another feature consists in that the support means includes a bell crank element, one arm of which is idly hinged on the advance shaft and the other arm of which is disposed at an angle of 90° with respect to the first. The forked slider is slidably mounted on the second arm and forms an angle of 90° with respect to the latter.

The main advantage of the present invention is that the means which support the forked slider are pivotable about a pivot point coincident with, or extremely close to the feed advance shaft and, as a result of which, the forked slider is always disposed coincident with the chord of the optimum path of the slider such that, as the latter is slidable in the forked slider, it does not produce substantial pressure variations between the rectilinear walls which guide it during its relative movements.

Other objects, features and advantages will be made apparent in the course of the following detailed description of the invention which is provided with reference to the accompanying drawings, in which:

DESCRIPTION OF THE PREFERRED EMBODIMENT

Figure 1:
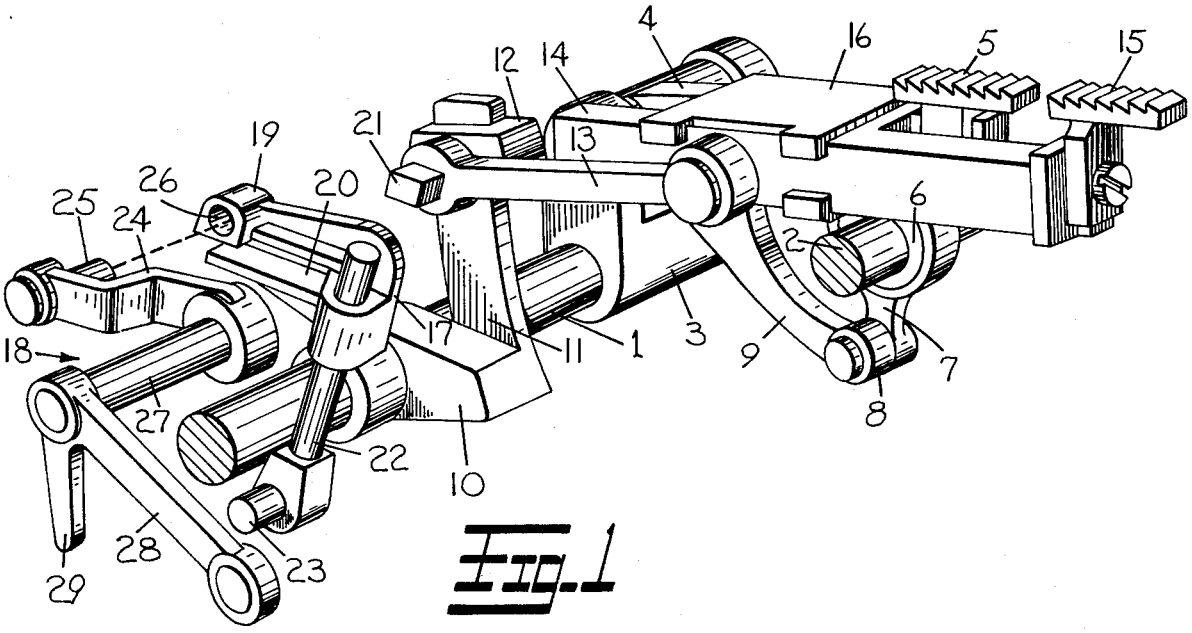
FIG. 1 is a perspective view of a preferred embodiment of the device according to the invention.

Referring now to FIG. 1, the adjusting device according to the present invention is used with a differential type of feed device, but it can obviously also be applied to a normal feed device as a conventional stroke adjusting stop for a single feed dog. The feed advance device generally comprises a feed advance shaft 1 which is driven by the main shaft 2 of the sewing machine by known means (not shown) comprising an adjustable eccentric and associated rod. A forked arm 3 is mounted on the feed advance shaft 1. A feed dog bar 4, to which the main feed dog or stitch dog 5 is attached, is hinged to the forked arm 3. As a result of this connection system, the main feed dog 5 moves alternately forwardly and rearwardly by a distance which is proportionate to the desired eccentricity with which the above-mentioned adjustable eccentric is provided.

In addition, the feed dog bar 4 is driven in an alternating lifting movement by an eccentric 6 fixed on the main shaft 2 by means of a rod 7 which is pivotably mounted to the lower end of an arm 9 that is operatively connected to the lower part of the feed dog bar 4. An arm 10 provided with a guide bar 11 is fixed on the feed advance shaft 1. A slider 12 is slidably mounted on the guide bar 11. A drive link 13 is hinged to the slider 12 and is adapted to provide a driving connection between the latter and a feed dog bar 14 which supports differential feed dog or auxiliary feed dog 15. This feed dog bar 14 is slidable in a guide element 16 mounted on the feed dog bar 4 so that the differential feed dog 15 is raised simultaneously with the main feed dog 5. The reciprocating movement of the differential feed dog 15 is initiated by the oscillation of the guide bar 11 and the breadth of this movement is determined by the position of the slider 12 on the guide bar 11.

More specifically, the stroke of the differential feed dog 15 possesses maximum breadth when the slider 12 is disposed in correspondence with the free end of the guide bar 11, while the breadth of this stroke is reduced as said slider is moved downwardly toward the arm 10.

The arm 10 supports the guide bar 11 which is displaced by the advance shaft 1, and thus to obtain a smaller minimum stroke of the differential feed dog than that which could be obtained if this guide bar were directly mounted on the feed advance shaft 1. Accordingly, by providing the arm 10, it is possible to obtain a shorter stroke of the differential feed dog 15 than that of the main feed dog 5 so as to obtain what is generally defined as "negative differential feed."

The positioning of the slider 12 along the guide bar 11 is effected by means of an adjustment device which includes a forked slider 17 and control means 18 operatively associated with said forked slider.

The forked slider 17 is provided with two prongs 19 and 20 between which a slide element 21 which is pivotally connected to the slider 12 is adapted to extend. The forked slider 17 is slidably mounted on a support means which includes a rod member 22 pivotable on a pin 23 that is attached to the frame of the sewing machine (not shown). The axis of this pin 23 is disposed parallel to the axis of the feed advance shaft 1. The forked slider 17 is slidably mounted on the support means in such a way that the prongs 19 and 20 define an angle of 90° with respect to the rod member 22. The control means 18 includes a first lever 24, one end of which comprises a pin 25 assembled in a corresponding seat 26 provided in the prong 19 of the forked slider 17, and the other end of which is fixed on a shaft 27 supported by the aforementioned sewing machine frame in such a way as to project externally of the latter. A second lever 28, which can be actuated by the operator either manually or by means of conventional auxiliary means, is fixed on the projecting end of the shaft 27. The second lever 28 includes a stroke limiting member 29 that is adapted to cooperate with two conventional steps (not shown) which serve to limit the movements of the control means 18 and consequently, to limit the position adjustment range of the slider 12 along the guide bar 11.

Manipulation of the second lever 28 causes the forked slider 17 to move along the aforementioned rod-type element 22 which, as may be noted from FIG. 1, rotates about its respective pin 23, thus bringing this forked slider with its respective axis 30, almost coincident with the chord of the arc 31 which the slider 12 would follow as a result of the oscillations of the guide bar 11 if it were not detained by the slider by means of the slide element 21 which is retained between the prongs 19 and 20.

As a result of the fact that the axis of the pin 23 is not coincident with the axis of the feed advance shaft 1, but is displaced with respect to the same, it is not possible to otain perfect coincidence between the end points of the rectilinear path covered by the slide element 21 and the cord of the arc 31 as there is no correspondence between the end positions of the slider 12 on the guide bar 11. The displacement between the rectilinear path covered by the slide element 21 in correspondence with all the possible adjustments adopted by the forked slider 17, this path coinciding with the axis 30 of the slider 12 with respect to the chord of the corresponding arc 31, becomes smaller the closer the pin 23 of the support means for the forked slider 17 is disposed to the feed advance shaft 1.

Figure 3:
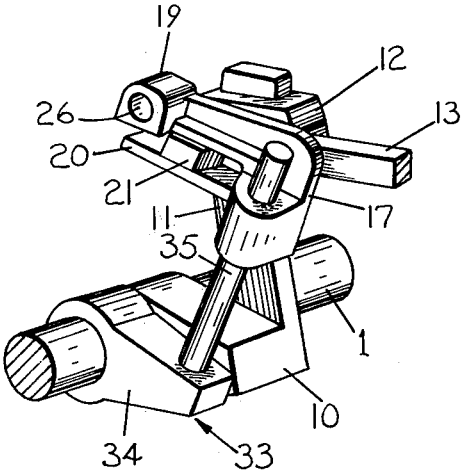
FIG. 3 is a perspective view showing a modification of the device in FIG. 1.
Figure 2:
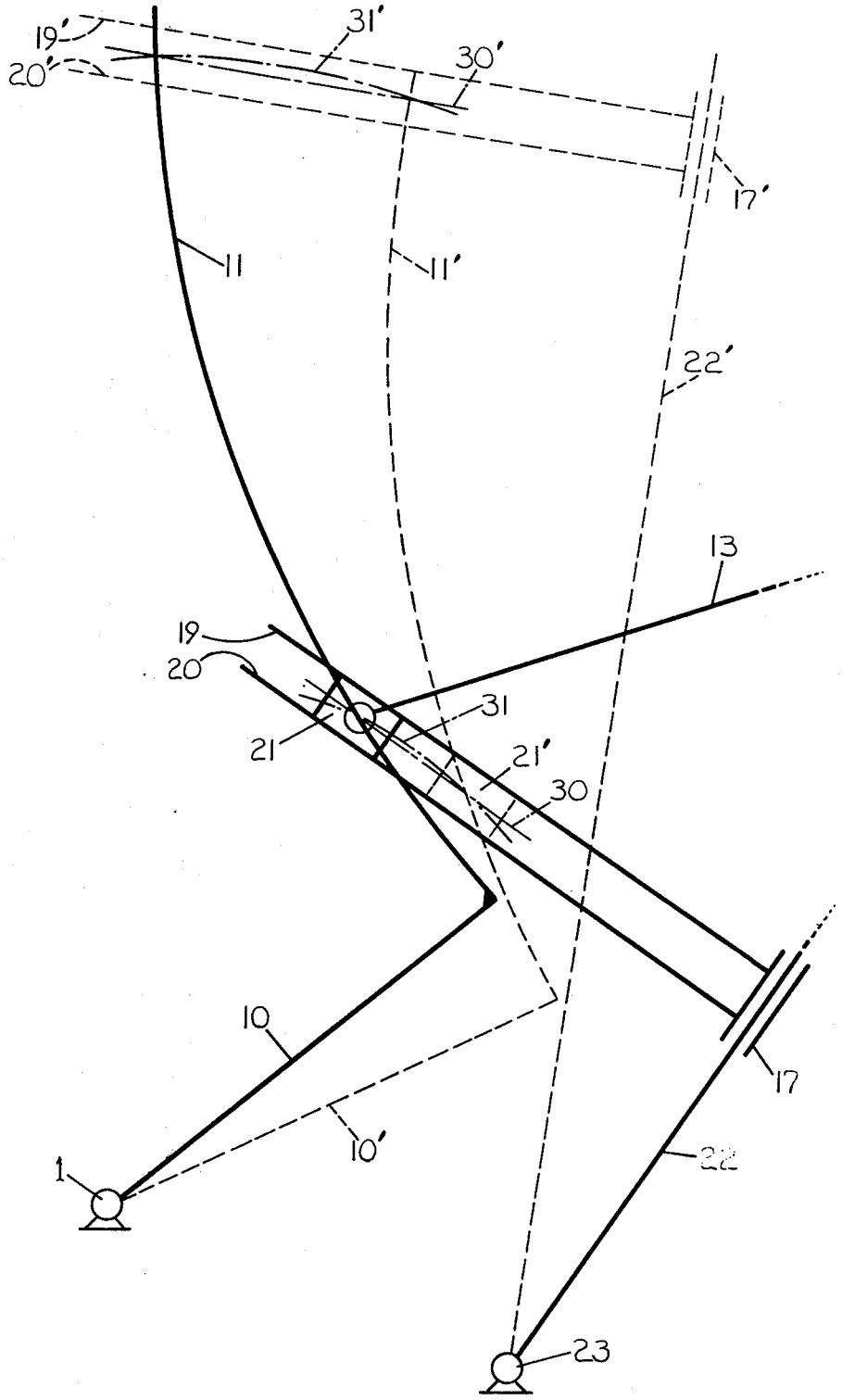
FIG. 2 is a diagram of the movements of the various parts of the device.

In the embodiment represented in FIG. 1, this displacement is infinitesimal. It is thus completely negligible and does not have a negative influence on the mechanical coupling between the slide element 21 and the forked slider 17 or on the law regulating the movement of the differential feed dog 15. Any type of displacement is completely eliminated by the provision of an adjustment device of the aforementioned type in which the support means provided for the forked slider (See FIG. 3) consist of a bell crank element 33, one of whose arms 34 is pivotably mounted on the feed advance shaft 1 and a second arm 35, on which the forked slider 17 is slidably mounted is disposed at an angle of 90° with respect to the first.

In this modification of the adjustment device, the parallelogram formed by the forked slider 17, by the arm 35 on which this forked slider is engaged in such a way that its axis forms an angle 90° with respect to the latter, by the first arm 34 and by the connecting axis of the shaft 1 with the slider 12, is not deformed in any way regardless of how the forked slider is moved across the control means 18.

As a result, it is possible to obtain the optimum geometrical disposition of the different movable elements of the device according to the invention in the case of any desired adjustment of the differential feed advance system.

Although the present invention has been described in connection with a preferred embodiment, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A feed adjusting device for sewing machines in which the feed dog bar is actuated by a drive link interconnecting it with a slider movably mounted on a guide bar having an arm oscillatably driven by the machine's feed advance shaft, said feed adjusting device comprising:

a. a forked slider (17) operatively connected to the slider;

b. a control means (18) connected to said forked slider (17) for effecting movement of the slider on the guide bar during movement thereof by the feed advance shaft; and c. support means (22, 33) attached to said forked slider for positioning the latter so as to maintain the axis (30) thereof substantially coincident with the path of travel of the slider.

2. The feed adjusting device according to claim 1 wherein said support means includes a pin (23) fixed on the machine, and a rod member (22) pivotably mounted on said pin 23 for slidably suppoting said forked slider (17) thereon in a plane extending normal to the axis of said rod member.

3. The feed adjusting device according to claim 1 wherein said support means includes a bell crank element (33) having one arm (34) pivotably mounted on the feed advance shaft and a second arm (35) disposed at a right angle to said arm (34) for slidably supporting said forked slider (17) thereon in a plane extending normal to the axis of said second arm (35).

* * * * *